US005632420A

United States Patent [19]

Lohrman et al.

[11] Patent Number: 5,632,420

[45] Date of Patent: May 27, 1997

[54] DISPENSING PACKAGE

[75] Inventors: Richard D. Lohrman, Grayslake; Ronny M. Cisliek, Arlington Heights, both of Ill.

[73] Assignee: Zeller Plastik, Inc., Libertyville, Ill.

[21] Appl. No.: 425,088

[22] Filed: Apr. 19, 1995

Related U.S. Application Data

[63] Continuation-in-part of Ser. No. 148,202, Nov. 3, 1993, abandoned.

[51] Int. Cl.[6] ..... B65D 37/00

[52] U.S. Cl. ..... 222/212; 222/494; 222/490

[58] Field of Search ..... 222/181, 206, 222/212, 215, 494, 495, 496, 497

[56] References Cited

U.S. PATENT DOCUMENTS

| | | | |
|---|---|---|---|
| D. 271,746 | 12/1983 | Pieri | D9/337 |
| 1,989,714 | 2/1935 | Statham | 222/490 |
| 4,728,006 | 3/1988 | Drobish et al. | 222/181 |
| 4,749,108 | 6/1988 | Dornsbusch et al. | 222/212 |
| 5,033,655 | 7/1991 | Brown | 222/212 |
| 5,071,017 | 12/1991 | Stull | 222/490 X |
| 5,115,950 | 5/1992 | Rohr | 222/212 X |
| 5,213,236 | 5/1993 | Brown et al. | 222/212 X |
| 5,271,531 | 12/1993 | Rohr et al. | 222/212 |

FOREIGN PATENT DOCUMENTS

| | | | |
|---|---|---|---|
| 2098958 | 3/1982 | United Kingdom | 222/181 |

*Primary Examiner*—Andres Kashnikow
*Assistant Examiner*—Kenneth Bomberg
*Attorney, Agent, or Firm*—Kane, Dalsimer, Sullivan, Kurucz, Levy, Eisele and Richard, LLP

[57] ABSTRACT

A dispensing package including a resiliently deformable bottle and an overcap capable of being coupled with the top of the bottle to protect a self-sealing dispensing valve. The valve is coupled with the overcap or a closure. The overcap includes a hinged lid pivotal from a closed position at which it protects the valve to an open position at which product in the bottle may be dispensed when the package is inverted.

28 Claims, 10 Drawing Sheets

DISPENSING PACKAGE

REFERENCE TO RELATED APPLICATIONS

This patent application is a continuation-in-part of U.S. patent application Ser. No. 08/148,202, filed Nov. 3, 1993, now abandoned.

BACKGROUND OF THE INVENTION

A dispensing package is gaining commercial acceptance in which a flexible bottle, when inverted and squeezed, opens a self sealing dispensing valve in the bottle closure at a predetermined threshold pressure to discharge the content of the bottle. When the external forces on the bottle are removed, and the internal pressure in the bottle is reduced below the predetermined threshold pressure for dispensing, the valve closes. The valve remains closed as long as the threshold pressure is not exceeded.

SUMMARY OF THE INVENTION

A principal object of the present invention is to provide a valved overcap for a dispensing package for viscous fluids utilizing a self sealing dispensing valve of the foregoing type; and which package may be readily stored and shipped following filling without concern over inadvertent dispensing or leakage of product; and which overcap may be readily manipulated with only one hand to cause dispensing of the product.

A further object is to provide a dispensing package having a self sealing dispensing overcap of the foregoing type which is inexpensive to manufacture utilizing a minimum of parts that permits use of many different styles of overcaps that enables a marketer to choose between many different ornamental and aesthetic packaging designs.

An important object is to provide a dispensing package of the foregoing type that employs an overcap having a protective pivotal lid for a self sealing dispensing valve which provides a high degree of control over the amount of product dispensed, which is self-clearing upon the application of squeezing forces to the flexible bottle, and which is self-sealing upon removal of squeezing forces applied to the flexible bottle.

A dispensing package of the foregoing type includes a resiliently and flexibly deformable bottle having an overcap with a self sealing dispensing valve having slits and normally being in a concave sealed position. A pivotal lid forming part of the overcap covers and protects the valve during storage and shipment. In use by a consumer, the lid is initially pivoted to an open position to expose the valve. The bottle is then inverted and may be squeezed by applying manual forces for purposes of generating internal pressures that exceed a threshold value to effect shifting of the valve from an inwardly concave sealed position before it will dispense any product through its slits. When the threshold value is exceeded, the valve undergoes movement from the inwardly concave position, to an open, outwardly convex position. When the squeezing forces are released, the internal pressures are reduced causing the valve to return towards its inwardly concave position, to effectuate product cut-off. During this return there is a momentary inward opening of the valve enabling venting of the bottle interior to occur. The valve will quickly return to its sealed leak-proof position and the dispensing package can remain in its inverted position without fear or concern over leakage of product.

Dispensing packages of the present invention permit the use of a single hand, to dispense product in a neat fashion. If the dispensing package is used in a shower and contains shampoo, for example, one hand can squeeze the bottle while the other receives the shampoo.

The several aforenoted objects and advantages will become apparent from the following detailed description which is to be taken in conjunction with the accompanying drawings.

DETAILED DESCRIPTION OF THE PREFERRED EMBODIMENT

Figure 1:
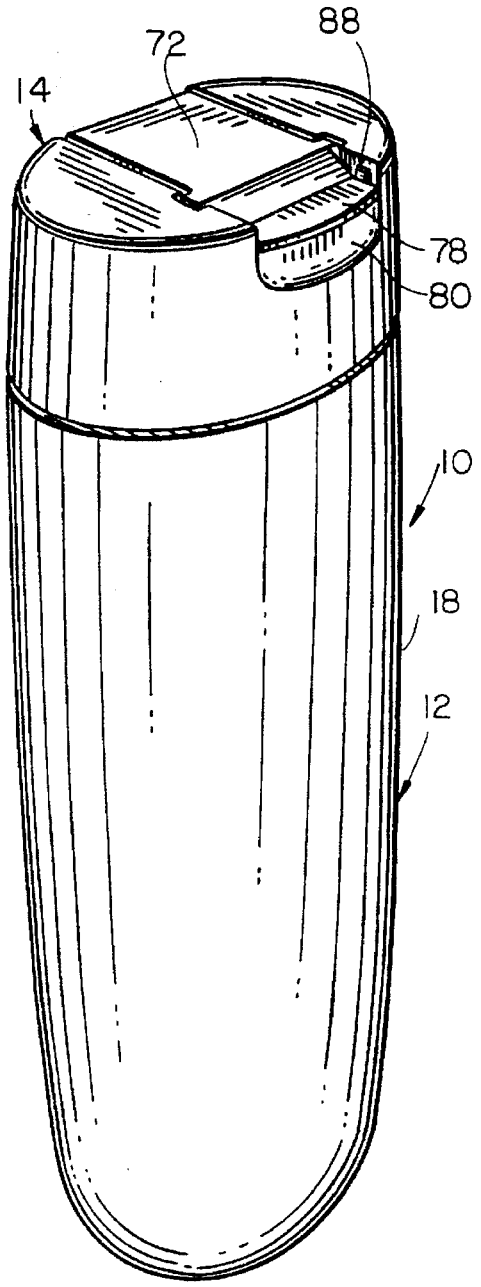
FIG. 1 is a front perspective view of a dispensing package of this invention with a 3-piece overcap having a self sealing dispensing valve and a closed lid on an upright squeeze bottle containing product to be dispensed.

In the drawings, with specific reference to FIGS. 1–9, a dispensing package 10 is shown and is particularly adapted for dispensing fluid products, such as liquid soaps, household cleaners, polishes, moisturizing creams, foodstuffs, and the like. Package 10 includes a container or bottle 12, and 3-piece overcap 14.

The bottle 12 is preferably resiliently deformable and may be conveniently blow molded from one of many well known resins such as polypropylene, polyethylene, polyvinyl, polyethylene terepthalate (PET) or the like. Bottle 12 should exhibit a sufficient degree of flexibility to permit manual deformation by squeezing of the side wall 18 to extrude product through the valved closure 16. The bottle 12 should also exhibit a sufficiently strong bias or predisposition to return to its undeformed condition when external forces are removed so that a substantial instantaneous pressure drop will be generated within the bottle, thereby assisting the seal of the valved closure 16 in a manner to be described in detail.

The sidewall 18 of the bottle 12 may be oval in cross section and is provided with an upper flat section 18*a* that serves to orient the bottle 12 during the assembly process and also accommodates surfaces of the overcap 14 during use. A neck 20 projects from the top 22 and defines bottle opening 24. The neck 20 includes a circumferentially and outwardly extending lip 26 that engages with inner complimentary surfaces in overcap 14 for purposes of securing the overcap 14 on the top 22 and neck 20 of the bottle. The top 22 includes a reduced sidewall part 28 that is slightly tapered and is provided with a flat section 28*a* for receiving surfaces of the overcap 14. The top 22 also includes a conical shoulder 30 located between neck 20 and the reduced sidewall part 28. This shoulder 30 is formed with a flat section 30a that accommodates surfaces of the overcap 14.

The self sealing dispensing valve 16 comprises a one-piece integrally molded member preferably constructed from liquid silicone rubber, or the like. The valve includes a concave valve head 32 with cross-slits 34 defining pie shaped flaps 36 and a discharge orifice therein. A connector sleeve 38 has one end connected with the marginal flange 40, and the opposite end connected with valve head 32 adjacent its marginal edge. Connector sleeve 38 is resiliently flexible such that when pressure within bottle 12 is raised above a predetermined threshold value, connector sleeve 38 will be caused to extend outwardly and valve head 32 to shift outwardly as described in detail in the above referenced application.

The valve head 32 has a circular plan shape, and a generally tapered thickness which is thicker at the radially outside portion of valve head 32 and thinner at the radially inside portion thereof. For further details of a self sealing dispensing valve and the functioning of its parts usable with this invention, reference is made to U.S. Pat. No. 5,213,236 which is incorporated herein by reference. When the valve 16 is pressurized by squeezing the sidewall 18 of bottle 12, the connector sleeve 38 and concave valve head 32 extends outwardly, as previously explained, and the pie-shaped flaps 36 formed by cross-slits 34 open and unfold outwardly with a torqued snapping action to permit product to be dispensed therethrough. The snap type opening of valve 16 is believed to be achieved in part by the torque exerted on valve head 32 by the connector sleeve 38. Negative pressure on the interior side of the valve 16 causes a reverse flow through the cross-slits 34. Under these circumstances, the connector sleeve 38 and valve head 32 will return to its fully concave orientation with a torqued snap action. During this return action, air will be sucked back through the cross-slits 34 into the interior of bottle 12 until any vacuum therein is substantially equalized. As the pressure differential on opposite sides of the valve 16 decreases to zero, cross-slits 34 reform into their original securely sealed configuration even under the hydraulic head pressure applied thereto by the product within bottle 12 when inverted.

Reference is now made to the overcap 14 which is formed of one piece and during shipping and storage particularly before consumer purchase, serves to protect valve 16. Overcap 14 includes a top 44 from which depends an outer tubular conical skirt 46 that compliments the outer configuration of the reduced side wall part 28 of the top 20 of bottle 12; and the skirt bottom 48 rests on the ledge formed between side wall 18 and this reduced side wall part 28. An inner concentric downwardly depending cylindrical sleeve 50 includes an inwardly extending bead 52 which is captured by the lip 26 of the bottle neck 20 in securing the overcap 14 on the top 22 and neck 20 of the bottle 12.

A ledge 54 extends radially inwardly from the sleeve 50 and defines a circular opening 56 across which the self-sealing dispensing valve 16 extends. In this regard, a circumferentially extending seat 58 advantageously receives the marginal flange 40 of the valve 16. A circumferentially extending rib 60 includes an outwardly extending bead 62. The flange 40 is clamped into place by the retainer ring 64 which snap fits over bead 62 of rib 60 received in accommodating recess 61. The ring 64 is provided with a central circular opening 66 to permit discharge of product from the valve 16.

A downwardly depending sealing flange 68 on the interior of ledge 54 serves to engage with and form a seal with the internal surfaces of the neck 20 of bottle 12.

Figure 2:
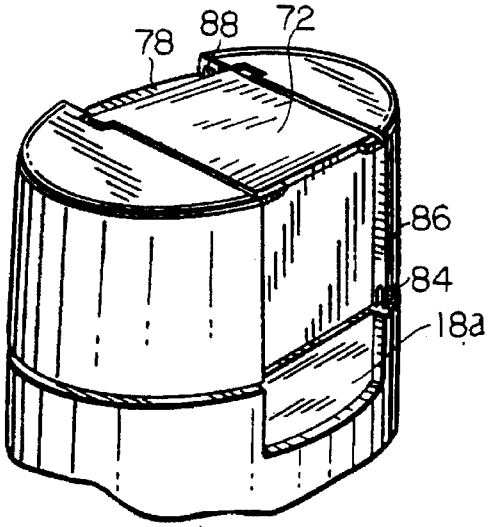
FIG. 2 is a rear perspective view thereof with the lower part of the bottle broken away and removed.
Figure 2A:
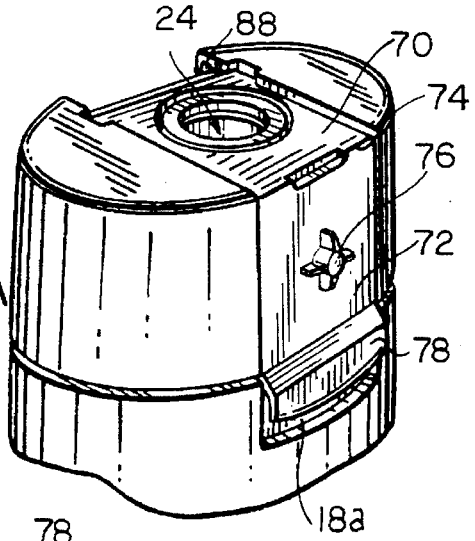
FIG. 2A is a similar view with the lid fully opened and latched in this position.
Figure 3:
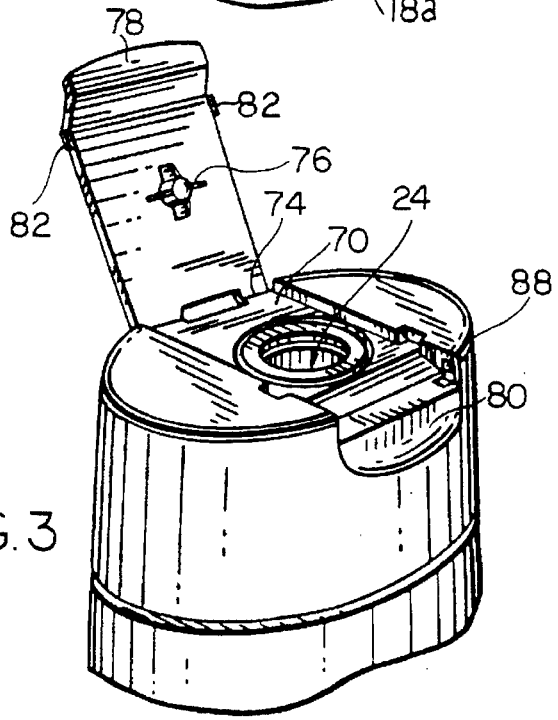
FIG. 3 is a front perspective view thereof with the lid open and the lower part of the bottle broken away and removed.
Figure 4:
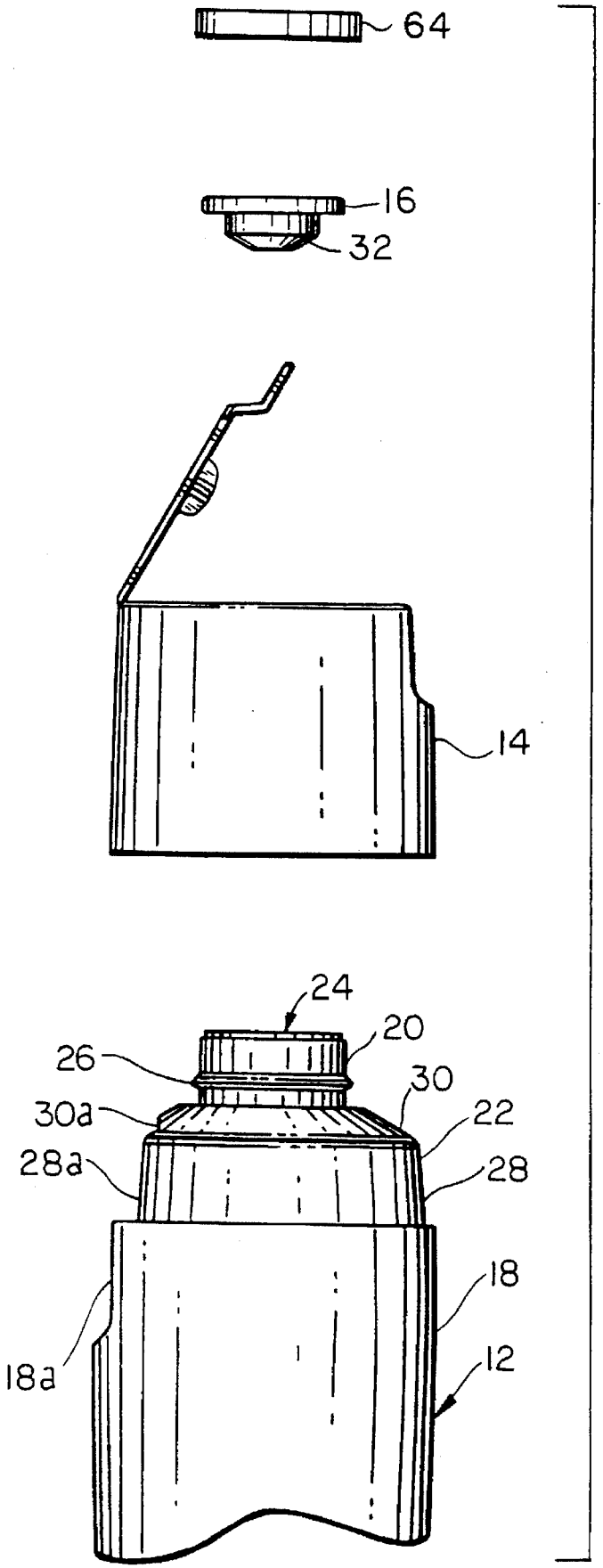
FIG. 4 is an exploded elevational view of the 3-piece overcap.
Figure 5:
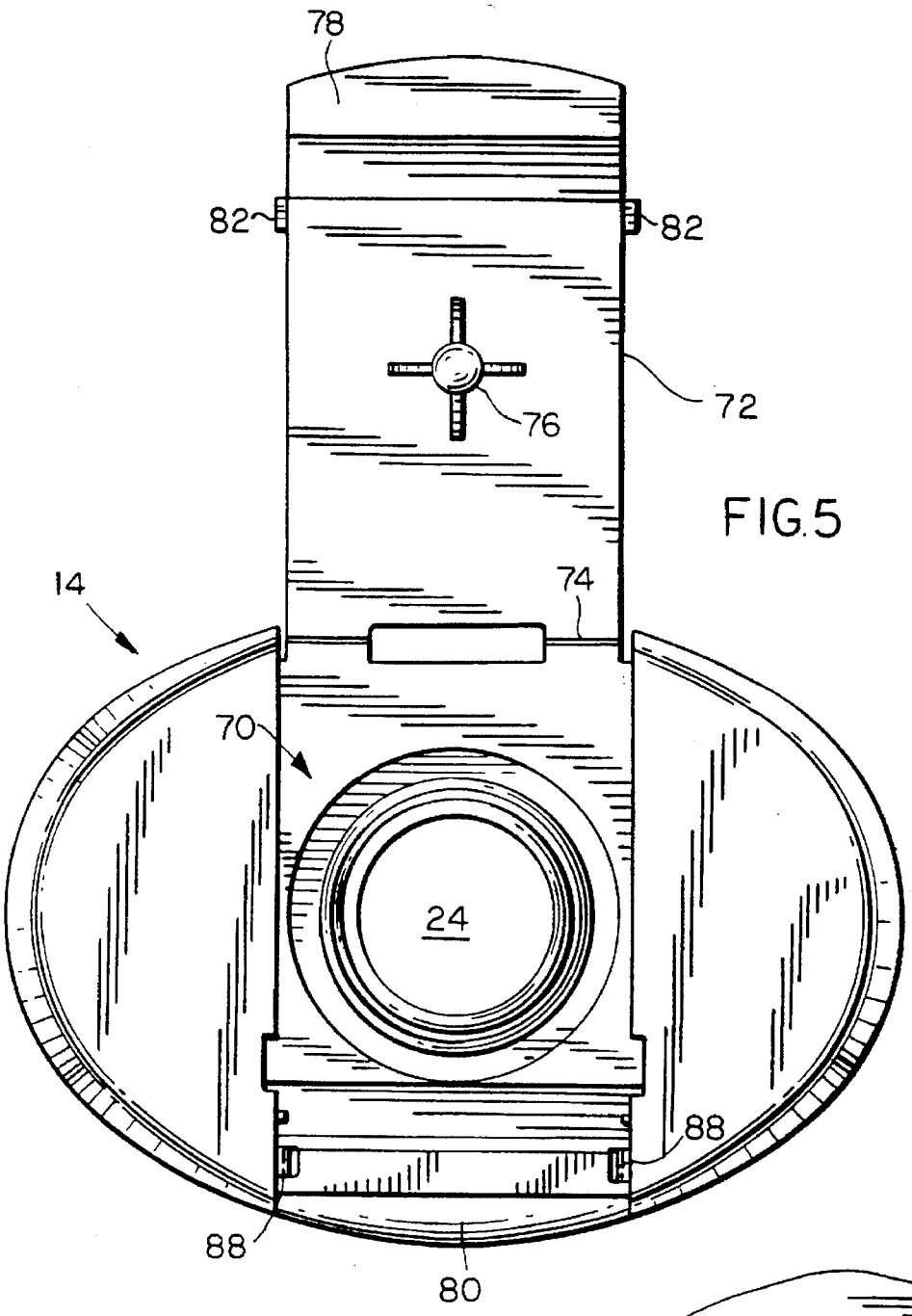
FIG. 5 is a top plan view of the overcap with the lid open and the valve removed.
Figure 6:
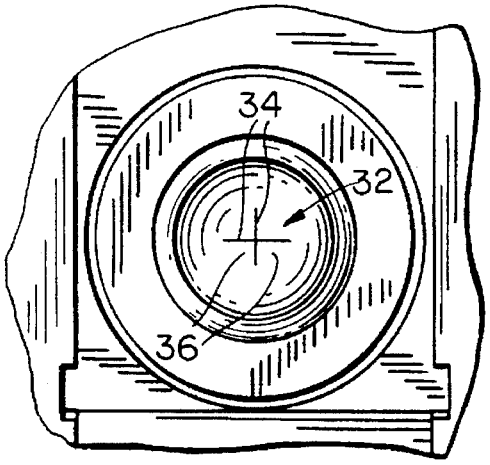
FIG. 6 is a fragmentary top plan view of the overcap with the valve in place.
Figure 7:
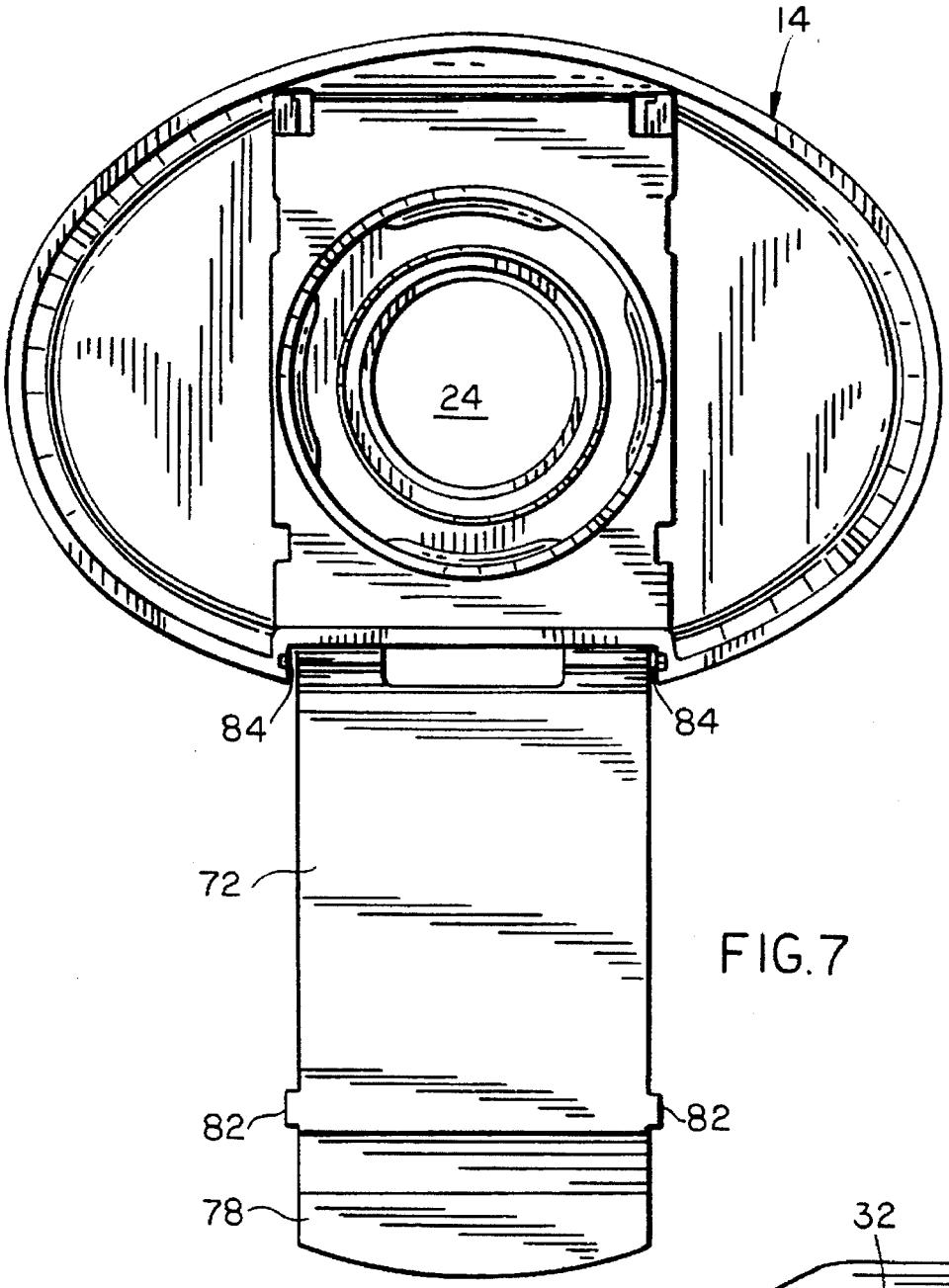
FIG. 7 is a bottom plan view of the overcap with the valve removed.
Figure 8:
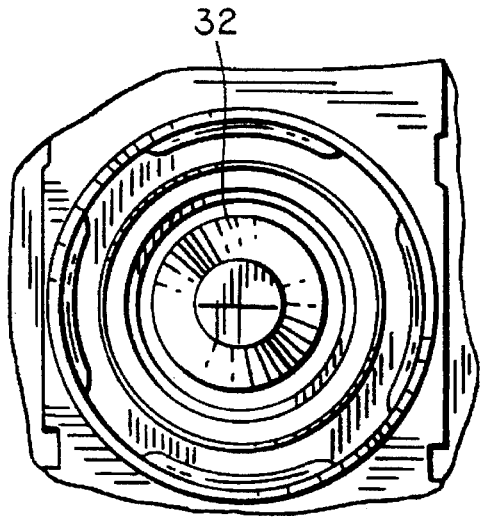
FIG. 8 is a fragmentary bottom plan view of the overcap with the valve in place.
Figure 9:
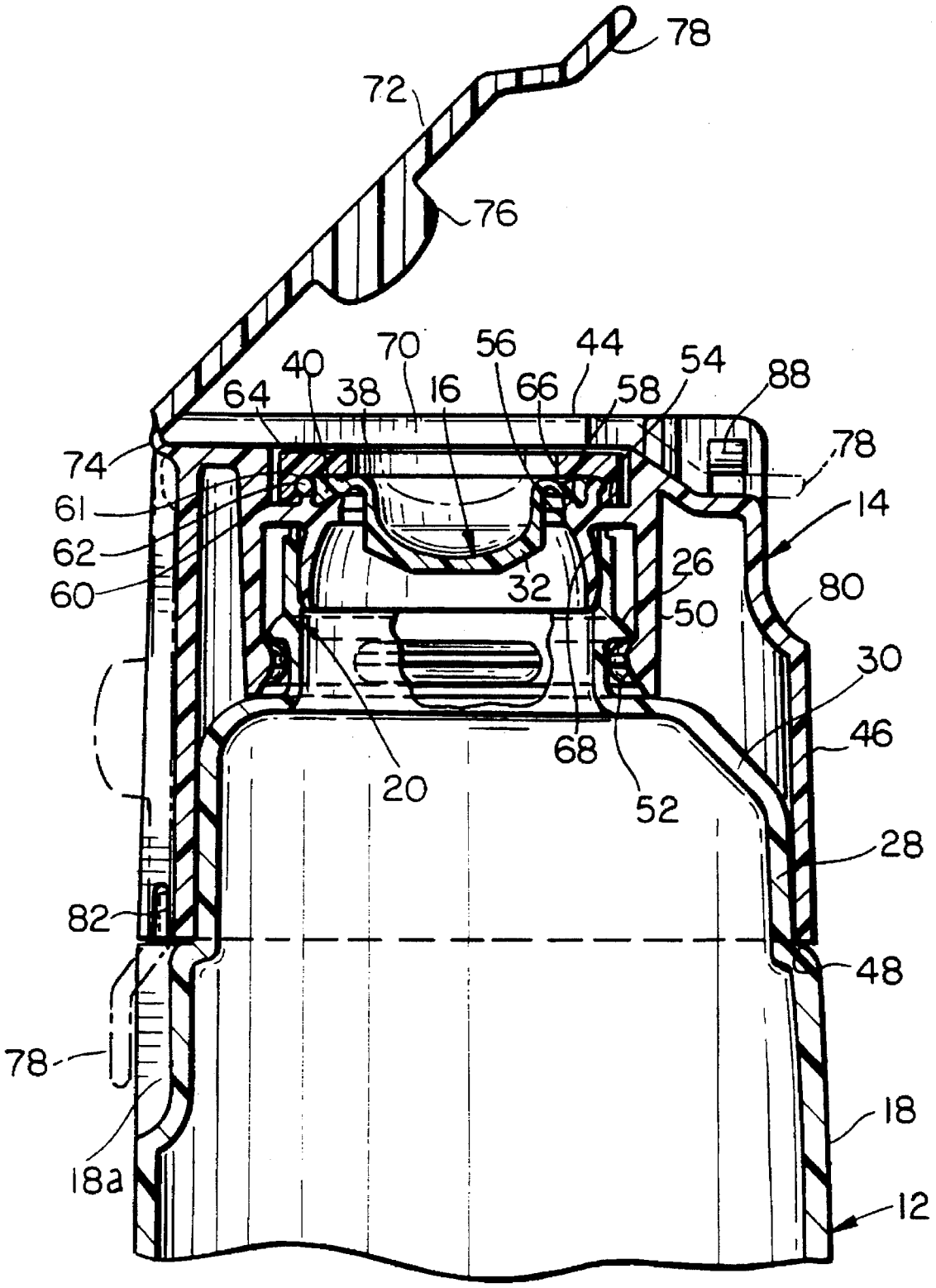
FIG. 9 is a cross sectional view of the 3-piece overcap on the squeeze bottle with the lid slightly open and its two extreme open and closed positions shown in phantom.
Figure 10:
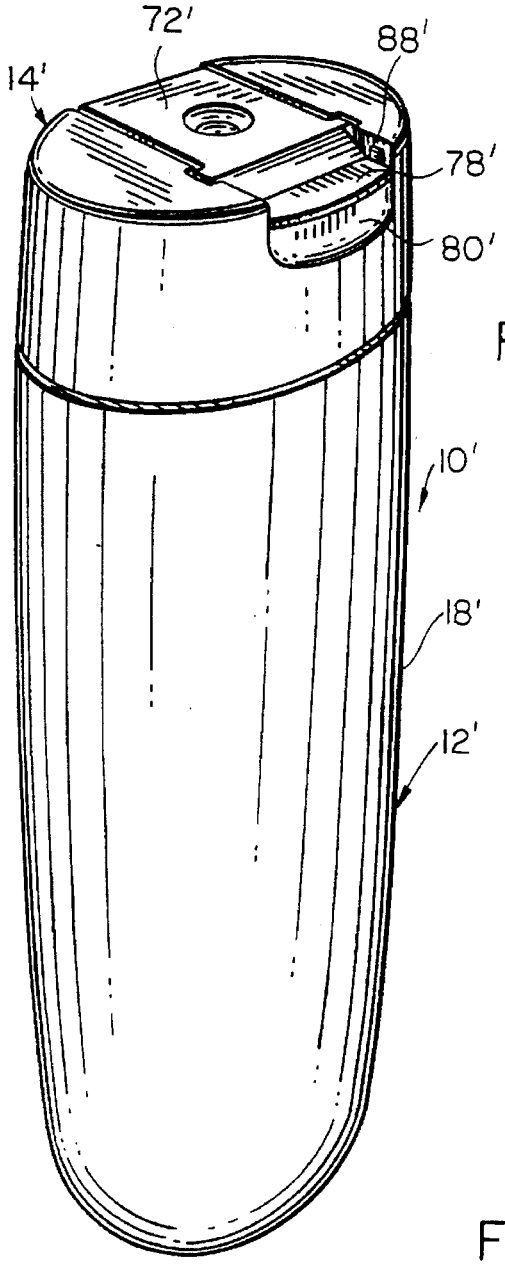
FIG. 10 is a front perspective view of a dispensing package of this invention with a 4-piece overcap having a self sealing dispensing valve and a closed lid on an upright squeeze bottle containing product to be dispensed.
Figure 11:
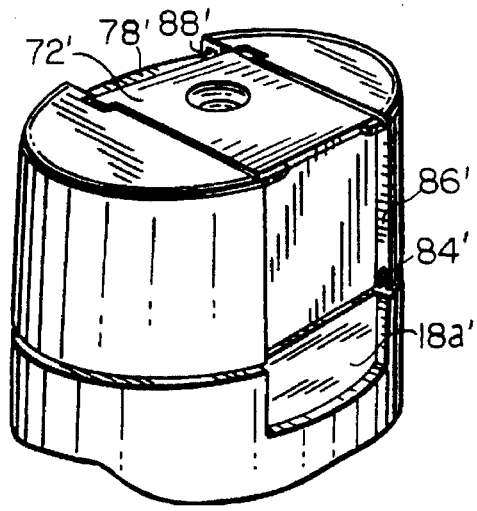
FIG. 11 is a rear perspective view thereof with the lower part of the bottle broken away and removed.
Figure 11A:
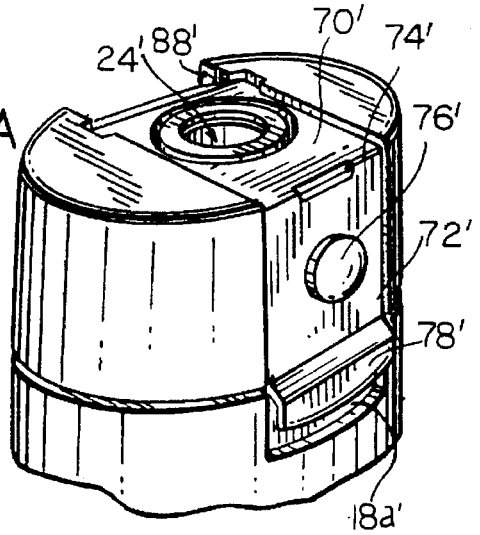
FIG. 11A is a similar view with the lid fully opened and latched in this position.
Figure 12:
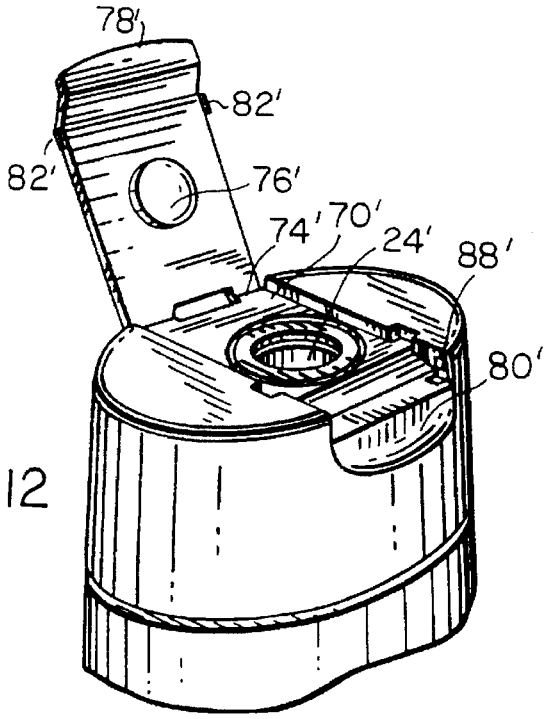
FIG. 12 is a front perspective view thereof with the lid open and the lower part of the bottle broken away and removed.
Figure 13:
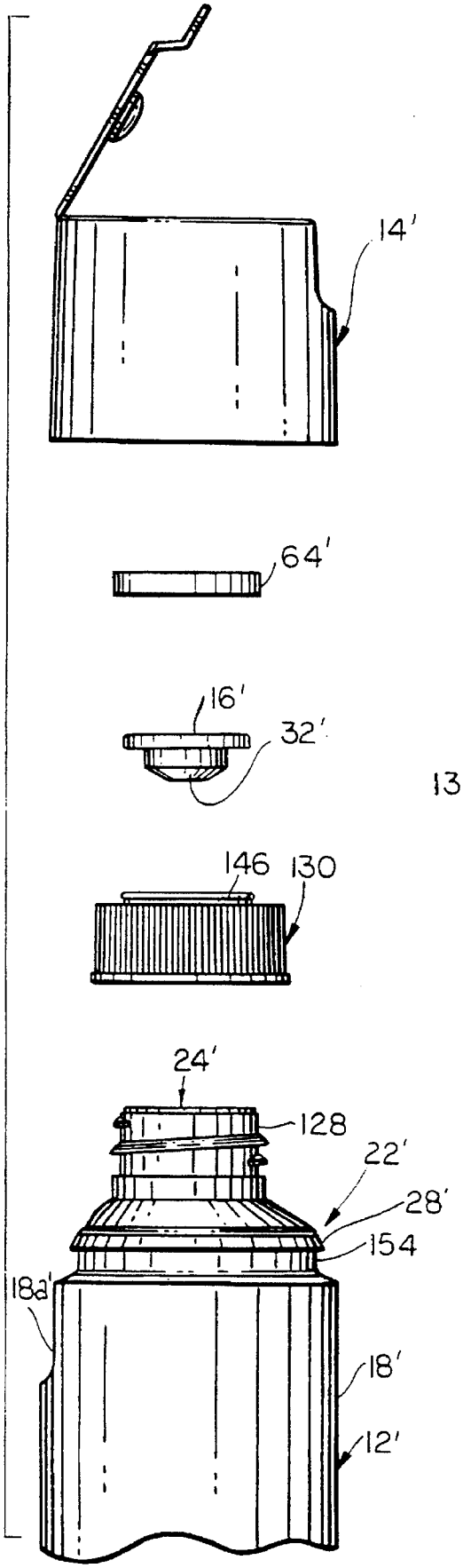
FIG. 13 is an exploded elevational view of the 4-piece overcap.
Figure 14:
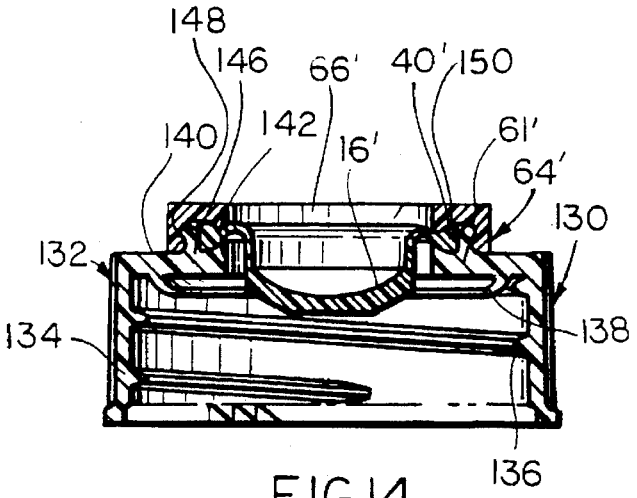
FIG. 14 is a cross sectional view of the assembled self sealing dispensing valve sub assembly.
Figure 15:
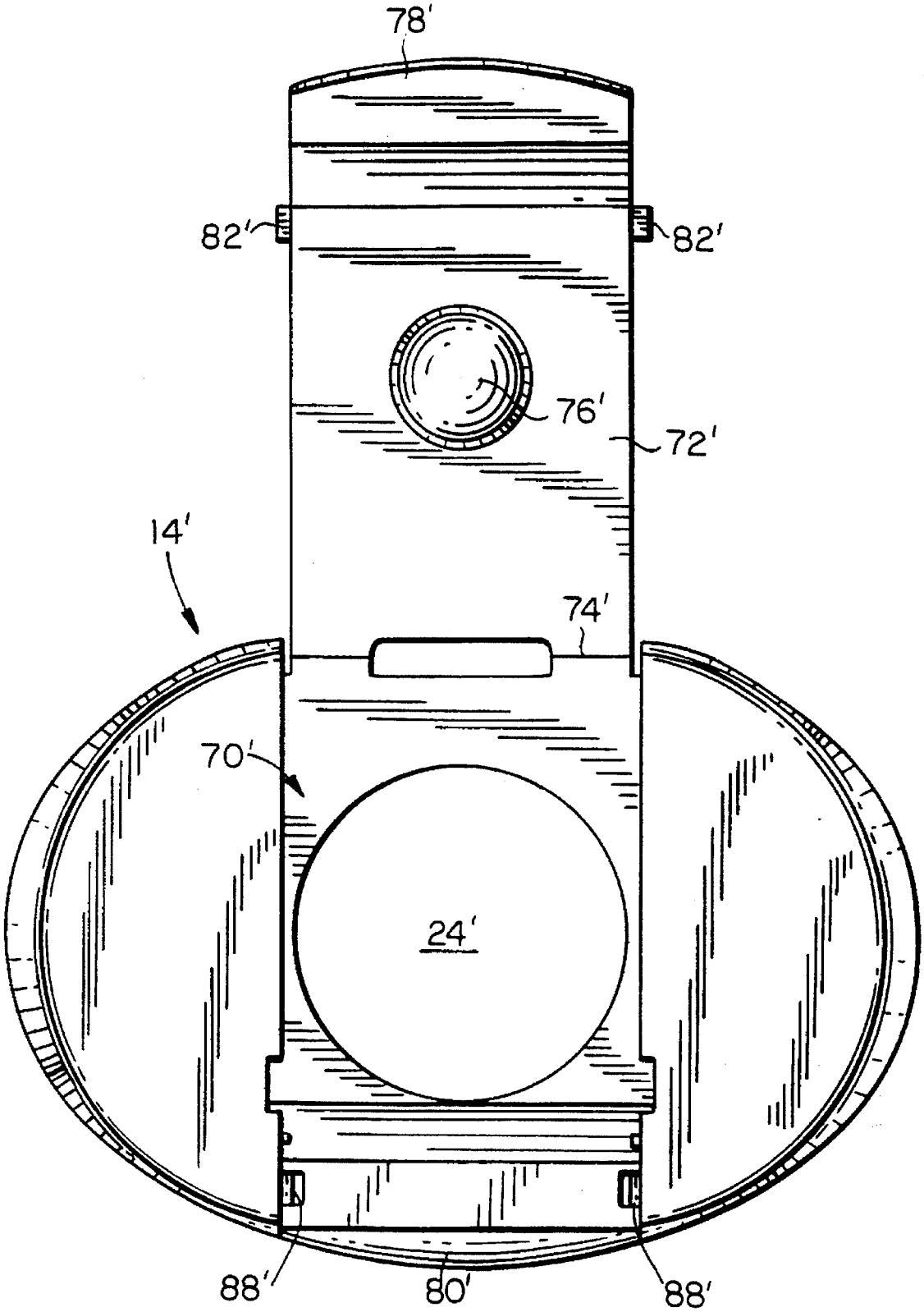
FIG. 15 is a top plan view of the overcap with the lid open with its valve sub assembly removed.
Figure 16:
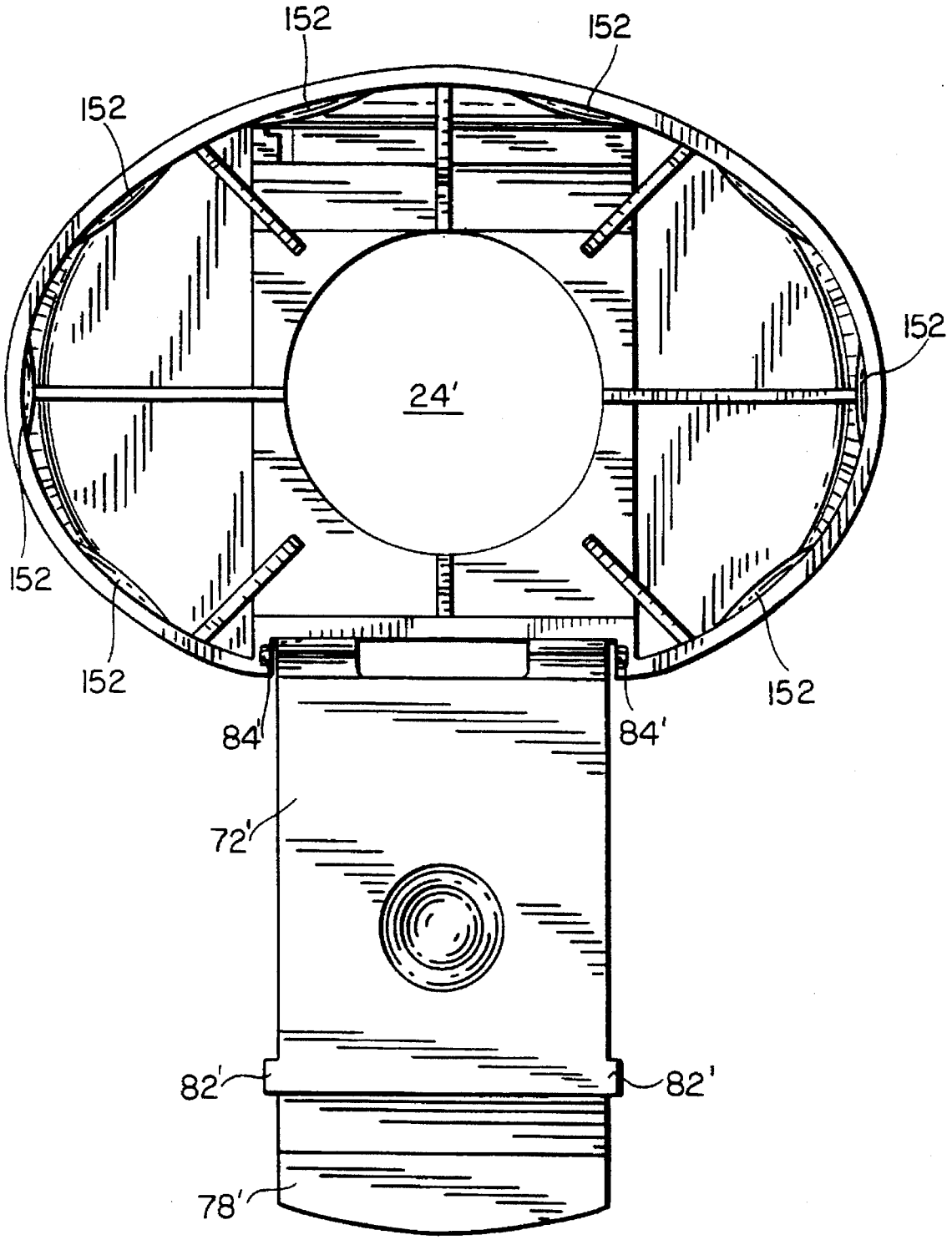
FIG. 16 is a bottom plan view of the overcap with the valve sub assembly removed.
Figure 17:
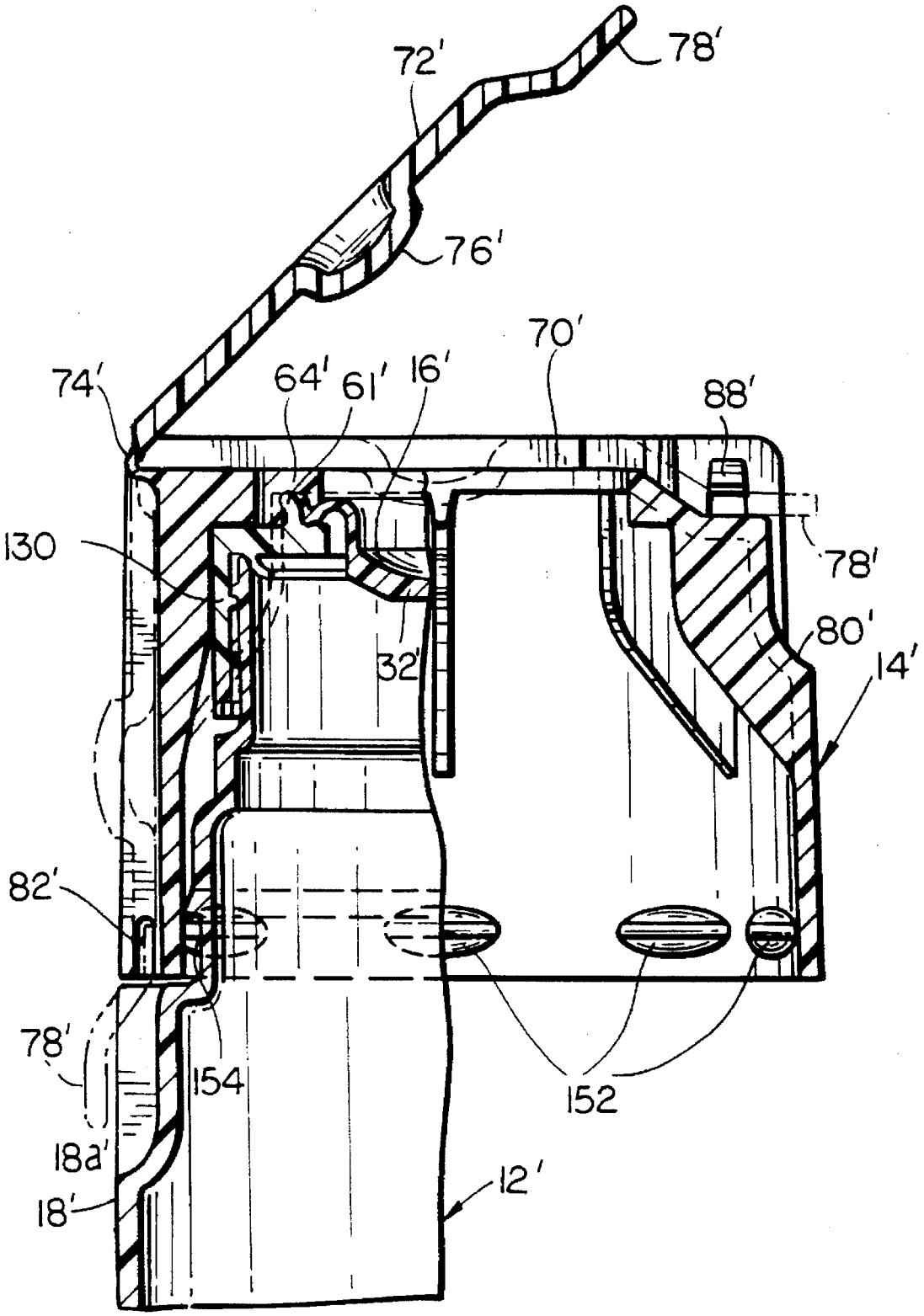
FIG. 17 is a cross sectional view of the 4-piece overcap on the squeeze bottle with the lid slightly open and its two extreme open and closed positions shown in phantom.

The top 44 of the overcap 14 is provided with a recess 70 that accommodates and receives integrally molded lid 72. Lid 72 is pivoted from a fully open position as shown in phantom in FIG. 9 to a completely closed position as shown in FIGS. 1, 2 and in phantom in FIG. 9 by means of the hinge 74. The lid 72 is provided with a downwardly projecting cylindrical boss 76 which is advantageously adapted to be disposed within the valve 16 to prevent the valve 16 from inadvertently opening and maintain and assure its sealed condition during shipping and storage prior to consumer purchase. The free end of the lid 72 is provided with an offset finger engaging tab 78 that projects outwardly from the recessed portion 80 of outer skirt 46 of the overcap 14 to facilitate opening by raising the lid from its closed position as shown in phantom in FIG. 9 to its fully open position also as shown in this Figure. In the open position, lugs 82 engaged within recess 84 in the recess 86 in the flat section 28*a* to releasably latch and maintain the lid in this position during product dispensing. The top 78 engages with lugs 88 in the recessed section 70 of the top 44 to releasably latch and maintain the lid in its closed position.

When the user desires to dispense and use product from the bottle 12, the lid 72 is pivoted to its open position, and the bottle is inverted. The product within the bottle 12 may then be dispensed in a fashion described in detail in the above.

Reference is now made to the 4-piece overcap of FIGS. 10–17 wherein like parts will be similarly numbered with an accompanying prime. In this embodiment, a valved closure 130 similar to that disclosed in the above referenced application replaces internal parts of the 3-piece overcap of the previous embodiment. The closure 130 includes a base 132 having a downwardly depending apron 134 provided with internal threads 136 for mating with the threads of neck 128. An internal circumferentially extending sealing lip 138 engages with the top of neck 128 to provide a seal at this juncture. The base 132 include a top 140 from which the lip extends and defines a circular opening 142 across which the self-sealing dispensing valve 16 extends. A circumferentially extending rib 146 is on the top 40 and includes an outwardly extending flange 148. The top 40 is also provided with a circular recess 150 that advantageously receives marginal flange 40' of the self sealing dispensing valve 16'. This flange 40' is clamped into place by the retainer ring 64' which snaps over flange 148 of rib 146 received in accommodating recess 61'. The ring 64' is provided with a central circular opening 66' to permit discharge of product from valve 16'.

The overcap 14' is anchored to the top 22' of bottle 12' by internal lugs or beads 152 snapping into annular recess 154 in the reduced sidewall part 28'. In all other respects, overcap 14' is similar to the previous embodiment.

Thus, the several aforenoted objects and advantages are most effectively attained. Although a single somewhat preferred embodiment has been shown and described in detail herein, it should be understood that this invention is in no sense limited thereby and its scope is to be determined by that of the appended claims.

What is claimed is:

1. A dispensing package for storing and dispensing a fluid product having a maximum hydraulic head pressure through a discharge orifice in response to manually applied lateral squeezing forces and for automatically ceasing the dispensing operation when the manually applied forces are removed, comprising:

a resiliently deformable bottle for containing the product to be dispersed, said bottle exhibiting a degree of flexibility sufficient to permit deformation thereof in response to manually applied lateral squeezing forces and a degree of resilience sufficient to return automatically to its undeformed condition when the manually applied forces are removed therefrom, said bottle having an interior for the product, a top and bottom and integral sidewall interposed therebetween, the bottom being closed and the top having a neck defining an opening into the interior of the bottle;

a self-sealing dispensing valve having a periphery and a central valve head having the discharge orifice which opens at a predetermined threshold pressure which is greater than the maximum hydraulic head pressure of the product in said bottle when the dispensing package is in an inverted position with the discharge orifice facing downwardly, retaining means for retaining and sealing the periphery of the self-sealing dispensing valve across the opening of the neck of the bottle, said valve head having a predetermined inwardly concave configuration while the valve is in an unstressed condition and the valve is sealingly retained across the opening of the neck of the bottle and the bottle is in an undeformed condition, said valve head having at least one slit defining the discharge orifice extending through its thickness from an innermost surface to an outermost surface, said valve exhibiting an ability to undergo movement from a closed, inwardly concave, sealed and leak-resistant position to an open, outwardly convex, unsealed position when said manually applied lateral squeezing forces increase the pressure inside the bottle beyond the threshold opening pressure of said valve, to open the slit and consequently the discharge orifice whereby product is discharged from said bottle through the discharge orifice as long as the manually applied squeezing forces on the bottle maintain an internal pressure exceeding the threshold opening pressure of the valve, said valve also exhibiting an ability to automatically cut-off the product discharge by returning to its closed, inwardly concave, sealed and leak-resistant position whenever the manually applied forces are removed from the bottle;

a valved closure having a base being mounted on the neck of the bottle across the neck opening, the valved closure including a top on the base, the top having an opening across which extends the self-sealing dispensing valve, said top having a circular rib extending around the opening in the top of the valved closure and means for receiving the periphery of the self-sealing dispensing valve, and the retaining means including a circular ring cooperating with the circular rib to secure the valve periphery to the top of the valved closure; and a one-piece overcap having a top and an outer tubular skirt disposed over the sidewall of the bottle and securement means including interengaging surfaces of the overcap and bottle for securing the overcap to the bottle, the securement means including interengaging surfaces on the bottle sidewall and overcap skirt, a lid hinged at the top of the overcap and pivotal from a closed position at which it is coextensive with the top of the overcap and protects the valve and an open position at which product in the bottle may be dispensed when the package is inverted with the discharge orifice facing downwardly.

2. The dispensing package of claim 1 wherein the top of the overcap is recessed and the lid is accommodated therein when the lid is in its closed position.

3. The dispensing package of claim 2 wherein latching means releasably latches the lid in its closed position.

4. The dispensing package of claim 1 wherein the lid has a downwardly depending boss that is disposed within the valve when the valve is in an unstressed condition when the lid is in its closed position.

5. The dispensing package of claim 1 wherein the lid has a free end having a finger engaging tab extending beyond the skirt that facilitates shifting of the lid from its closed position to its open position.

6. The dispensing package of claim 5 wherein the skirt is recessed to accommodate and protect the tab and to facilitate the gripping of the tab when the lid is in its closed position.

7. The dispensing package of claim 1 wherein the skirt is recessed to receive and accommodate the lid when it is in its fully open position.

8. The dispensing package of claim 7 wherein latching means releasably latches the lid in its fully open position.

9. The dispensing package of claim 1 wherein the top of the overcap is recessed and the lid is accommodated therein when the lid is in its closed position; latching means releasably latches the lid in its closed position; the lid has a downwardly depending boss that is disposed within the valve when the valve is in an unstressed condition when the lid is in its closed position; the lid has a free end having a finger engaging tab extending beyond the skirt that facilitates shifting of the lid from its closed position to its open position; the skirt is recessed to accommodate and protect the tab and to facilitate the gripping of the tab when the lid is in its closed position; the skirt is recessed to receive and accommodate the lid when it is in its fully open position; latching means releasably latches the lid in its fully open position.

10. The dispensing package of claim 1 wherein the overcap includes an inner concentric cylindrical sleeve, and the securement means includes interengaging surfaces on the bottle neck and sleeve.

11. The dispensing package of claim 10 wherein a ledge extends radially inwardly from the sleeve, and has an opening across which extends the self sealing dispensing valve, the sleeve includes a circular rib extending around the opening and having an outwardly projecting bead, and means for receiving the periphery of the self sealing dispensing valve, and the retainer means including a circular rib and flange with an accommodating recess cooperating with the circular rib to secure the valve periphery.

12. The dispensing package of claim 1 wherein the ring and rib include coupling means for clamping the periphery of the valve therebetween in a sealed fashion including an outwardly projecting flange on the rib and an accommodating recess in the ring.

13. The dispensing package of claim 12 wherein the valve head includes a pair of intersecting linear slits.

14. The dispensing package of claim 13 wherein the self-sealing dispensing valve includes an integral sleeve interconnecting the valve head and periphery of the valve.

15. A one-piece overcap assembly for a deformable bottle for containing the product having maximum hydraulic head pressure to be dispersed, said bottle exhibiting a degree of flexibility sufficient to permit deformation thereof in response to manually applied lateral squeezing forces and a degree of resilience sufficient to return automatically to its undeformed condition when the manually applied forces are removed therefrom, said bottle having an interior for the product, a top and bottom and integral sidewall interposed therebetween, the bottom being closed and the top having a neck defining an opening into the interior of the bottle, the assembly comprising:

a self-sealing dispensing valve having a periphery and a central valve head having a discharge orifice which opens at a predetermined threshold pressure which is greater than the maximum hydraulic head pressure of the product in said bottle when the bottle is in an inverted position with the discharge orifice facing downwardly, retaining means for retaining and sealing the periphery of the self-sealing dispensing valve across the opening of the neck of the bottle, said valve head having a predetermined inwardly concave configuration while the valve is in an unstressed condition and the valve is sealingly retained across the opening of the neck of the bottle and the bottle is in an undeformed condition, said valve head having at least on slit defining the discharge orifice extending through its thickness from an innermost surface to an outermost surface, said valve exhibiting an ability to undergo movement from a closed, inwardly concave, sealed and leak-resistant position to an open, outwardly convex, unsealed position when said manually applied lateral squeezing forces increase the pressure inside the bottle beyond the threshold opening pressure of said valve, to open the slit and consequently the discharge orifice whereby product is discharged from said bottle through the discharge orifice as long as the manually applied squeezing forces on the bottle maintain an internal pressure exceeding the threshold opening pressure of the valve, said valve also exhibiting an ability to automatically cut-off the product discharge by returning to its closed, inwardly concave, sealed and leak-resistant position whenever the manually applied forces are removed from the bottle;

a valved closure having a base being mounted on the neck of the bottle across the neck opening, the valved closure including a top on the base, the top having an opening across which extends the self-sealing dispensing valve, said top having a circular rib extending around the opening in the top of the valved closure and means for receiving the periphery of the self-sealing dispensing valve, and the retaining means including a circular ring cooperating with the circular rib to secure the valve periphery of the top of the valved closure;

a one-piece overcap having a top and an outer tubular skirt for being disposed over the sidewall of the bottle and securement means for securing the overcap to the bottle, the securement means including interengaging surfaces on the overcap skirt for engaging surfaces of the bottle sidewall, a lid hinged at the top of the overcap and pivotal from a closed position at which it is coextensive with the top of the overcap and protects the valve and an open position at which product in the bottle may be dispensed when the bottle is inverted with the discharge orifice facing downwardly.

16. The assembly of claim 15 wherein the overcap includes an inner concentric cylindrical sleeve, and the securement means includes interengaging surfaces on the sleeve for engaging surfaces of the bottle neck.

17. The assembly of claim 16 wherein a ledge extends radially inwardly from the sleeve, and has an opening across which extends the self sealing dispensing valve, the sleeve includes a circular rib extending around the opening and having an outwardly projecting bead, and means for receiving the periphery of the self sealing dispensing valve, and the retainer means including a circular rib and flange with an accommodating recess cooperating to secure the valve periphery.

18. The assembly of claim 15 wherein the top of the overcap is recessed and the lid is accommodated therein when the lid is in its closed position.

19. The assembly of claim 18 wherein latching means releasably latches the lid in its closed position.

20. The assembly of claim 15 wherein the lid has a downwardly depending boss that is disposed within the valve when the valve is in an unstressed condition when the lid is in its closed position.

21. The assembly of claim 15 wherein the lid has a free end having a finger engaging tab extending beyond the skirt that facilitates shifting of the lid from its closed position to its open position.

22. The assembly of claim 21 wherein the skirt is recessed to accommodate and protect the tab and to facilitate the gripping of the tab when the lid is in its closed position.

23. The assembly of claim 15 wherein the skirt is recessed to receive and accommodate the lid when it is in its fully open position.

24. The assembly of claim 23 wherein latching means releasably latches the lid in its fully open position.

25. The assembly of claim 15 wherein the top of the overcap is recessed and the lid is accommodated therein when the lid is in its closed position; latching means releasably latches the lid in its closed position; the lid has a downwardly depending boss that is disposed within the valve when the valve is in an unstressed condition when the lid is in its closed position; the lid has a free end having a finger engaging tab extending beyond the skirt that facilitates shifting of the lid from its closed position to its open position; the skirt is recessed to accommodate and protect the tab and to facilitate the gripping of the tab when the lid is in its closed position; the skirt is recessed to receive and accommodate the lid when it is in its fully open position; latching means releasably latches the lid in its fully open position.

26. The assembly of claim 15 wherein the ring and rib include coupling means for clamping the periphery of the valve therebetween in a sealed fashion including an outwardly projecting flange on the rib and an accommodating recess in the ring.

27. The assembly of claim 26 wherein the valve head includes a pair of intersecting linear slits.

28. The assembly of claim 27 wherein the self-sealing dispensing valve includes an integral sleeve interconnecting the valve head and periphery of the valve.

* * * * *